US008555561B2

(12) United States Patent
Dickinson et al.

(10) Patent No.: US 8,555,561 B2
(45) Date of Patent: Oct. 15, 2013

(54) APPARATUS FOR SUPPORTING A CEMETERY HEADSTONE AND METHOD OF FABRICATING SAME

(75) Inventors: Robert Duncan Dickinson, Rancho Mirage, CA (US); Rodney Kenneth Knyvett, La Quinta, CA (US); Enrique Escamilla, Mililani, HI (US)

(73) Assignee: Source of Pride, LLC, Indio, CA (US)

( * ) Notice: Subject to any disclaimer, the term of this patent is extended or adjusted under 35 U.S.C. 154(b) by 0 days.

(21) Appl. No.: 13/295,164

(22) Filed: Nov. 14, 2011

(65) Prior Publication Data

US 2013/0031849 A1 Feb. 7, 2013

Related U.S. Application Data

(60) Provisional application No. 61/513,775, filed on Aug. 1, 2011.

(51) Int. Cl.
*E04H 13/00* (2006.01)

(52) U.S. Cl.
USPC ..... 52/103; 52/741.14; 52/169.1; 52/157; 405/241; 405/230; 40/124.5

(58) Field of Classification Search
USPC ..... 52/103, 157, 155, 292, 169.1, 741.14, 52/741.11; 248/530, 508, 156; 405/230, 405/232, 241, 259.1, 252.1, 253, 229, 231, 405/233, 239, 244, 256; 40/124.5
See application file for complete search history.

(56) References Cited

U.S. PATENT DOCUMENTS

| | | | | | |
|---|---|---|---|---|---|
| 1,365,635 | A | * | 1/1921 | Tyree | 52/103 |
| 1,425,361 | A | | 8/1922 | Beround | |
| 1,500,870 | A | * | 7/1924 | Holdredge | 52/155 |
| 1,843,602 | A | * | 2/1932 | Holmes | 52/27 |
| 1,966,922 | A | | 5/1933 | Coleman | |
| 1,982,432 | A | | 6/1933 | Hull | |
| 2,008,307 | A | * | 7/1935 | Kanamori | 405/256 |
| 2,207,012 | A | * | 7/1940 | Hopkins | 47/41.1 |
| 2,312,859 | A | | 2/1942 | Zentmyer | |
| 2,332,217 | A | | 4/1943 | Harner | |
| 2,525,091 | A | | 5/1948 | Brownawell | |
| 2,886,963 | A | | 5/1959 | Bergmann | |
| 3,438,159 | A | | 4/1969 | Bergener et al. | |
| 3,698,144 | A | * | 10/1972 | Stratton | 52/99 |
| 3,841,032 | A | * | 10/1974 | Grannis, III | 336/65 |
| 3,938,286 | A | * | 2/1976 | Mochinski | 52/103 |
| 4,019,294 | A | | 4/1977 | Bosico et al. | |
| 4,068,445 | A | * | 1/1978 | Bobbitt | 52/741.11 |
| D247,590 | S | | 3/1978 | Atherton et al. | |
| 4,175,363 | A | | 11/1979 | Moskowitz | |
| 4,285,149 | A | | 8/1981 | Berryhill | |
| 4,304,076 | A | | 12/1981 | Splendora | |
| 4,533,279 | A | * | 8/1985 | van den Elzen et al. | 405/239 |
| 4,548,526 | A | * | 10/1985 | Bullivant | 405/233 |
| 4,593,872 | A | * | 6/1986 | Svensson | 248/156 |
| 5,014,472 | A | | 5/1991 | Svensson | |
| 5,546,710 | A | * | 8/1996 | Barry | 52/104 |

(Continued)

*Primary Examiner* — Robert Canfield
*Assistant Examiner* — Babajide Demuren
(74) *Attorney, Agent, or Firm* — Rader, Fishman & Grauer, PLLC

(57) ABSTRACT

A headstone support system includes a pole having a first auger attached to the pole proximate a first end thereof, the first auger configured to drill through soil upon rotation of the pole, and a headstone support attached to a second end of the pole.

19 Claims, 3 Drawing Sheets

(56) References Cited

U.S. PATENT DOCUMENTS

| | | | | |
|---|---|---|---|---|
| 5,595,029 | A * | 1/1997 | Revoir et al. | 52/103 |
| 5,623,792 | A * | 4/1997 | Crumpacker | 52/126.7 |
| 5,653,563 | A | 8/1997 | Ernst et al. | |
| 5,657,586 | A * | 8/1997 | Bezler et al. | 52/103 |
| 6,352,390 | B1 * | 3/2002 | Jones | 405/230 |
| 6,352,391 | B1 * | 3/2002 | Jones | 405/252.1 |
| 6,659,692 | B1 * | 12/2003 | May | 405/232 |
| 6,682,267 | B1 * | 1/2004 | Jones | 405/252.1 |
| 6,705,804 | B2 | 3/2004 | Dierker | |
| 6,817,810 | B2 * | 11/2004 | Jones | 405/252.1 |
| 6,925,740 | B2 | 8/2005 | Shannon | |
| 7,144,201 | B2 | 12/2006 | DeArmond, Jr. | |
| 7,406,754 | B2 | 8/2008 | Trail | |
| D581,549 | S | 11/2008 | Thorkelson | |
| 7,637,061 | B2 * | 12/2009 | Murphy et al. | 52/103 |
| 2002/0176749 | A1 * | 11/2002 | Provost | 405/230 |
| 2003/0066259 | A1 | 4/2003 | Sudweeks | |
| 2003/0154663 | A1 | 8/2003 | Nelson | |
| 2004/0076479 | A1 * | 4/2004 | Camilleri | 405/252.1 |
| 2004/0091322 | A1 * | 5/2004 | May | 405/244 |
| 2004/0105727 | A1 * | 6/2004 | Jones | 405/231 |
| 2004/0169121 | A1 | 9/2004 | Winn | |
| 2005/0214077 | A1 | 9/2005 | DeArmond, Jr. | |
| 2005/0232696 | A1 | 10/2005 | Cheung | |
| 2005/0265790 | A1 | 12/2005 | Pasini | |
| 2006/0107605 | A1 | 5/2006 | Krahn | |
| 2006/0157631 | A1 | 7/2006 | Cunningham et al. | |
| 2007/0062142 | A1 | 3/2007 | Stott | |
| 2007/0212171 | A1 | 9/2007 | Rasmussen | |
| 2007/0212172 | A1 * | 9/2007 | Brown | 405/252.1 |
| 2007/0271868 | A1 | 11/2007 | Abella | |
| 2008/0028710 | A1 | 2/2008 | Alexander | |
| 2008/0104899 | A1 | 5/2008 | Hill | |
| 2008/0244994 | A1 | 10/2008 | Burman et al. | |
| 2008/0292410 | A1 | 11/2008 | Brown | |
| 2009/0142140 | A1 | 6/2009 | Collina et al. | |
| 2009/0217601 | A1 | 9/2009 | Perotti | |
| 2009/0229195 | A1 | 9/2009 | Murphy et al. | |
| 2010/0183378 | A1 * | 7/2010 | Goto | 405/253 |
| 2010/0205872 | A1 * | 8/2010 | Leyden | 52/103 |
| 2011/0036025 | A1 * | 2/2011 | Boulay | 52/157 |
| 2012/0079777 | A1 * | 4/2012 | Dearmond, Jr. | 52/103 |

* cited by examiner

APPARATUS FOR SUPPORTING A CEMETERY HEADSTONE AND METHOD OF FABRICATING SAME

CROSS-REFERENCE TO RELATED APPLICATION

The present application claims priority to U.S. Provisional Application 61/513,775 filed Aug. 1, 2011, the disclosure of which is incorporated herein.

BACKGROUND OF THE INVENTION

The present invention relates to an apparatus for supporting a headstone in conditions where the headstone is prone to motion over time, and a method of fabricating same.

Headstones or markers are placed at a grave as a memorial to the person buried there. In old cemeteries these headstones were placed by direct burial without consideration for the effects of time and the elements. Often, the support of an upright headstone is subject to ground movement caused by filled material, coffin or vault displacement, soil erosion, rain, irrigation, frost heaving, snow, wind, impacts, and the like. As cemeteries and the graves age, over time these factors contribute to headstone settlement, leading to repairs, and a need for realignment to the headstones to maintain an aesthetic appearance.

In many instances when it is desired to support a marker above a filled excavation, the headstone is not placed until a period of time has elapsed in order to allow settling of the recently excavated soil. This is necessitated because, after the excavation is filled, the contour of the ground changes as the fill dirt settles. Markers placed before the fill dirt settles may sink and shift if placed preliminarily.

One problem that can occur is when a coffin is placed in the ground without a burial vault. Typically, a burial vault is a concrete or brick structure that will not decay for a long period of time, which can be several decades or more. However, coffins are generally made of wood which can deteriorate significantly faster than a burial vault. Thus, when only a coffin is placed in the ground, the coffin deteriorates, causing the ground above the coffin to settle. This can lead to soil erosion and can cause a headstone or marker to shift over the long term.

Other factors can lead to shifting of a headstone over time. For instance, typically a graveyard may include grass that needs regular cutting and maintenance. Often, for convenience and efficiency purposes, a riding lawnmower or large powered push mower may be used to cut grass, leading inevitably to occasional contact with the headstone which can cause the headstone to move. Trimming around headstones may be done with a power-driven weed-wacker which can, as well, cause movement due to occasional contact from the weed-wacker or the operator of the weed-wacker.

Thus, there are many factors that can lead to shifting of a headstone or grave marker over time. As such, one known method for anchoring a headstone in the ground to avoid these problems includes placing heavy concrete below the surface proximate the coffin and mechanically coupling the headstone to the concrete. According to this method, concrete "caissons" are placed to either side of the coffin and a span or "plinth" is positioned across the tops of the caissons and below the surface, with the headstone attached to the plinth. The headstone is placed within a cavity of the plinth and attached thereto using aggregate material. Typically, the caissons are attached to the plinth using known devices such as rods that are set into the caissons and the plinth.

In such fashion, the headstone may be attached to the plinth, which in turn is coupled to the caissons. This can alleviate some of the known problems that occur to headstones due to contact from lawnmowers, weed-wackers, and the like, by providing a very heavy structure for the headstone. In addition, because the support caissons are positioned to either side of the coffin, and the headstone is placed within a plinth that is coupled to the caissons, settling of the headstone due to deterioration of the coffin may be avoided, as well, because the plinth spans across the top of the coffin.

Although some of the known problems that occur with headstones can be avoided using a concrete anchored structure, such a design is nevertheless prone to motion over time for other reasons. For instance, vibrations caused by seismic activity from heavy machinery, such as from a tractor or from a semi with trailer, can cause motion of the headstone over time. One known method of alleviating motion caused from seismic activity is to place dampening shims between the caissons and the plinth, reducing the amount of vibration of the headstone, thereby delaying or avoiding motion thereof over extended periods of time. However, such shims are themselves prone to decay over time and may only delay the seismic-induced motion from occurring. In addition, the caissons and plinths are also exposed to freeze/thaw cycles, and to moisture and dry conditions over extended periods of time which, likewise, can cause degradation of the structure eventually to the point where movement of the headstone can occur. A moisture seal may be employed to slow the decaying process, but such tends to be costly to purchase and apply during the fabrication process.

Headstones supported by caissons and a plinth can also be very expensive to fabricate for a number of other reasons. First, a significant amount of heavy material such as concrete is included in such a structure, which is expensive in and of itself. Additionally, in order to transport this heavy material, and its significant volume, adds transportation cost to the overall process. And, fabrication of the caissaons and the plinth is itself expensive, typically requiring a mold that is dedicated for each unit during a curing cycle. Further, each caisson must be set into the earth, requiring earth to be remove in a much larger volumetric area that is otherwise normally removed for just the coffin itself. Thus, the materials can be costly, and it can be costly to fabricate, transport, and install such a device to the site.

In addition, such devices and other known devices are nevertheless still prone to motion if not set deep enough into the earth. As known in the art, surface motion can occur to materials that are set above a freeze line in latitudes where freeze/thaw or dry/wet cycles typically occur. If in an extreme latitude, permafrost may exist below a line in which annual freeze/thaw does not occur. Thus, in either case and as known in the art, if structures are not placed deep below the line of annual freeze/thaw cycles, motion can occur over time due to the regular expansion and contraction that results from freezing and thawing.

Thus, there is a need for an improved headstone support system to minimize headstone displacement while reducing cost to build and install a headstone.

BRIEF DESCRIPTION OF THE INVENTION

The present invention provides a method and apparatus for supporting a headstone overcomes the aforementioned drawbacks. The present invention allows upper soil to move while transferring a load of a headstone, providing a support system below frost levels and below a settlement and/or movement zone.

According to one aspect, a headstone support system includes a pole having a first auger attached to the pole proximate a first end thereof, the first auger configured to drill through soil upon rotation of the pole, and a headstone support attached to a second end of the pole.

According to another aspect, a method of fabricating a headstone support system includes attaching an auger to a first end of a pole such that, when the pole is rotated and pressed into the ground, the auger is driven below a surface of the ground, wherein when the auger is below the surface of the ground, a second end of the pole is also below the surface of the ground but at a lesser depth than the auger, and fabricating a headstone support attachable to the second end of the pole such that, when the headstone support is attached to the second end of the pole, the headstone support is below the surface of the ground.

According to yet another aspect, a method of installing a headstone support system includes drilling a pole having an auger on a first end thereof into the ground, and attaching a headstone support to a second end of the pole that is opposite the first end of the pole.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

The present invention is described with respect to a support of a headstone in a cemetery as a memorial to a person buried there. The present invention is described as an apparatus and method of fabricating a support system for a headstone, and is applicable to fresh gravesites. As will be further illustrated, the present invention is applicable as well to older gravesites that are in need of repair after settling of a headstone has occurred over a long period of time. Although the present invention is described primarily with respect to headstone that may otherwise be caused due to freeze/thaw cycles, one skilled in the art will recognize that the present invention is applicable to settling and motion that is otherwise due to any number of factors, including but not limited to ground movement caused by filled material, coffin or vault displacement, soil erosion, rain, irrigation, frost heaving, snow, wind, impacts, and the like. Thus, the present invention is not only applicable to environments where freeze/thaw cycles occur, but is more broadly applicable to any environment where a headstone may be displaced over time due to soil erosion and other factors, such as in a climate proximate the equator where freezing does not typically occur.

Figure 1:
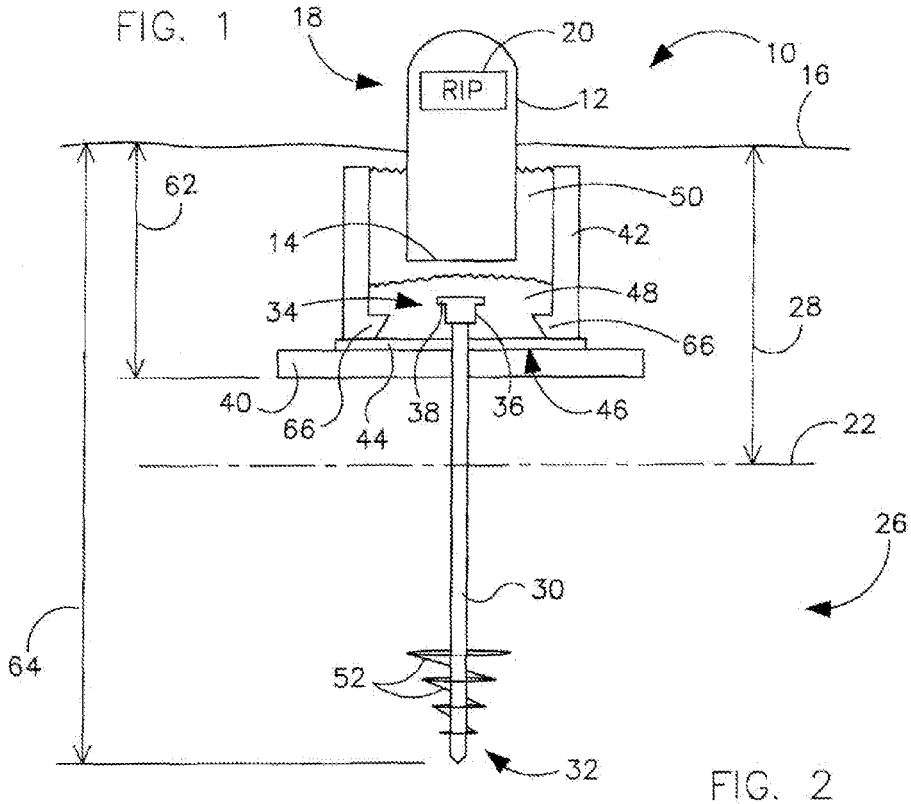
FIG. 1 is a headstone support system, according to an embodiment of the invention.

Referring to FIG. 1, a headstone support system 10 includes a headstone 12 having a base 14 placed below ground level 16 and a top portion 18 having, typically, an inscription 20 thereon. Typically, headstone 12 is made of marble, concrete, or other heavy material which may move or shift if not well supported. As discussed, typical headstones such as headstone 12 are placed such that base 14 is positioned above a line or level in the ground 22 below which tends to be stable. For instance, in a climate where freezing may occur during the winter months, a first region 24 above line 22 defines a volume of soil that may alternately freeze and thaw through the annual seasons, causing soil within first region 24 to heave and move over time. Below line 22, a second region 26 defines a location that does not alternately freeze and thaw in response to annual climatic cycles. That is, as known in the art, a certain depth of soil below line 22 is known that very rarely, if ever, experiences a freezing cycle. Further, as known in the art, the amount of freezing that a given region experiences will vary from year to year. During one year and in a mild winter, only a mild freeze may be experienced, while in another and more severe winter, a very deep freeze may be experienced. Thus, a headstone such as headstone 12 placed in the ground having its base above line 22, headstone 12 will be prone to motion over time due to the aforementioned reasons.

It is contemplated that a depth 28 of line 22 varies from region to region, and may also locally vary from year to year. Factors that affect depth 28 include but are not limited to a latitudinal global location, regional weather tendencies (e.g., mild northwest states such as Washington state or more severe weather northeast states such as Maine), annual weather cycles (e.g., depth of freeze, amount of precipitation), and the like. Thus, in typical climates within the United States, depth 28 may be as little as a few inches (southern states) to a few feet (northern states). However, in colder climates (such as in the Arctic north), line 22 may delineate first region 24 as a freeze/thaw, but second region 26 as a permafrost region. Still further, in warm climates where little or no annual freeze/thaw cycle occurs, line 22 may define first region 24 that is prone to motion from rain, soil erosion, and second region 26 that tends to be more stable (such as a deep clay that does not typically shift with time do to these aforementioned factors).

As such, according to the invention, depth 28 may be determined for a local region based on a number of factors that include but are not limited to those described above. However, one skilled in the art will recognize that in any given region, there tends to be a depth 28 that is known to provide a stable second region 26 that is not prone to annual or periodic motion. For instance, in northern climates of the United States, line 22 may be assumed generally to be at a depth 28 of 3-4 feet. Thus, in such an environment, regardless of the cyclical environmental factors that may cause motion of soil within first region 24, it may be safely assumed that below such a depth, in second region 26, soil motion does not occur. Further, according to the invention, depth 22 may be assumed having an additional depth, such as an additional foot (i.e., 12 inches) of depth in order to provide a safety factor against the more rare and occasional "hundred year freeze" or other rare event that may occur. Thus, in one example, in a northern climate it may be safe to assume that a 5 foot depth 28 of line 22 may provide a stable base of soil in second region 26 from which the invention may be practiced.

Thus, referring still to FIG. 1, headstone support system 10 includes a pole or shaft 30 having a first end 32 positioned below line 22 and in second region 26. Pole 30 is positioned in order to establish a stable anchor in second region 26 while providing mechanical coupling to headstone 12 such that, although headstone 12 is positioned in soil in unstable region 24, headstone 12 will nevertheless be stable over time because of the coupling to the stable pole 30 that is anchored in second region 26. Pole 30 includes a second end 34 having an anchor cap 36 attached thereto. Anchor cap 36, in one embodiment, fits over pole 30 and attaches thereto, and includes a flange 38 that serves to stabilize flange 38 within its surrounding medium. Headstone support system 10 includes a gravel base 40 and a precast headstone support 42 that is positioned on top of gravel base 40. In one embodiment, a compliant material such as Styrofoam 44 is placed between headstone support 42 and gravel base 40 in order to provide a cushion therebetween and allow slight relative motion between headstone support 42 and gravel base 40.

Headstone support 42 in one embodiment is a box-like structure having an opening 46 on the bottom, into which concrete or grout 48, a granular material such as gravel 50, and headstone 12 is placed. In one embodiment, outer dimensions of the box-like structure of headstone support 42 are approximately 21" wide and 12" in depth, but may be any dimensions that are sufficient to fit headstone 12, having wall thicknesses of 1-2". Headstone support 42 is placed on gravel base 40 in order that anchor cap 36 extends through opening 46 and into the surrounding medium which, in this embodiment, is grout 48. Gravel 50 is positioned on top of grout 48 and surrounds headstone 12. Pole 30 includes one or more augers 52 which, in the illustrated embodiment, are helical screws that are drilled into the ground using a downward force and a circular rotation (from above).

Figure 2:
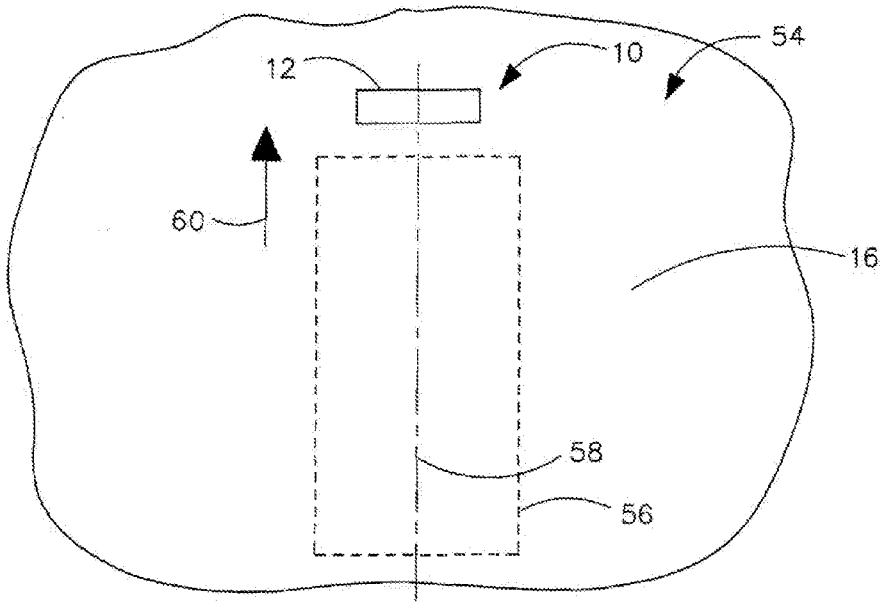
FIG. 2 is a plan view of a gravesite that incorporates embodiments of the invention.

Referring to FIG. 2, a plan view of a gravesite 54 shows a headstone 12 of headstone support system 10 (elements of headstone support system 10 are beneath ground 16). Gravesite 54 includes a coffin 56 (illustrated in phantom beneath ground 16). According to the invention, headstone support system 10 having headstone 12 is placed generally along a centerline 58 of gravesite 54. That is, because headstone 12 is offset axially 60 from coffin 56, pole 30 of headstone support system 10 may be positioned generally in line with centerline 58 of coffin 56. Further, because of the axial offset 60, embodiments of the invention may be used to repair older gravesites that have experienced motion of a headstone. That is, because of offset 60, the old headstone may be removed and replaced using an embodiment of the invention, without disturbing the remains that are in coffin 56.

Figure 3:
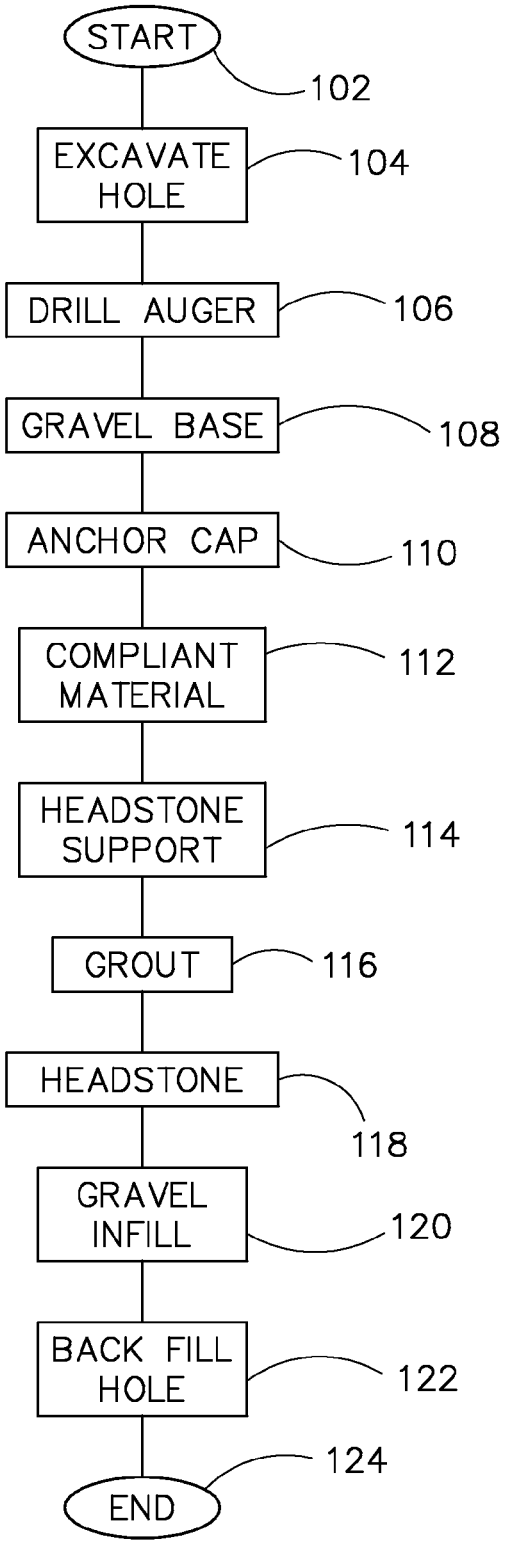
FIG. 3 is a method of installing a headstone support system, according to an embodiment of the invention.

Headstone support system 10 may be installed into the ground as illustrated by a process 100 that includes steps shown in FIG. 3. Starting at step 102, process 100 includes excavating a hole at step 104 which, referring to FIG. 1, is to an excavation depth 62 that corresponds to a depth at which gravel base 40 is to be placed. Pole or shaft 30 is drilled at step 106 into the ground and into the hole from step 104 to a pole depth 64 using a downward rotational force, causing auger 52 to drill into the ground. When positioned as such, second end 34 of pole 30 is also below ground level 16 but at a lesser depth than augers 52. In this embodiment, auger 52 serves the dual purpose of enabling the drilling process to occur, and auger 52 also remains in the ground at a depth below line 22 to serve as an anchor in second region 26.

Once pole 30 is drilled to the appropriate depth, gravel base 40 is installed at step 108 and anchor cap 36 is attached to pole 30 at step 110. A compliant or cushion material 44 (such as Styrofoam, low durometer rubber, and the like) is inserted onto gravel base 40 at step 112. Headstone support 42 is inserted into the hole, about anchor cap 36, and placed onto gravel base 40, at step 114. Grout 48 is placed into headstone support 42 at step 116 such that, once grout 48 is cured, it solidly couples cap 36 to headstone support 42, which is augmented via flange 38. That is, grout 48 serves to solidly couple headstone support 42, cap 36, and pole 30 to auger 52 one to another such that they all form a single unit that is solidly anchored into the ground at a depth that is below line 22. In such fashion, a solid and stable foundation is formed above line 22 into which headstone 12 is placed. Thus, at step 118, headstone 12 is placed into headstone support 42 and gravel infill 50 is provided at step 120. At step 122, dirt is used to fill above and around any remaining excavated area, and the process ends at step 124.

As such, the headstone is secured in a precast concrete vault filled with granular material. The vault is secured to a metal post or anchor that is anchored into the underlying soil and below the settlement or movement zone. The transfer of loads is accomplished with fins attached to the anchor which, in one embodiment, are angled from the horizontal position and serve as an auger in order to drive the pole into the ground. The anchor is, in one embodiment, a galvanized vertical shaft that penetrates the soil to the desired depth, thus transferring the vertical and horizontal loads imposed on the shaft to the underlying soil density. The length of the pole is selected such that, in one embodiment, first end 32 of pole 30 is positioned approximately six feet below an upper surface of the ground or ground level 16, while headstone support 42 is buried entirely underground (such as approximately 5" below the surface) but may be positioned above line 22, in first region 24 that is prone to motion. In one embodiment the length of pole 30 is approximately 5 feet in length and second end 34 of pole 30 is approximately 21" below ground level 16. In this example, depth 28 of line 22 may correspond to approximately 3 feet. However, as summarized, depth 28 of line 22 in the ground may be at a different depth than 3 feet, depending on the factors outlined (latitude, weather conditions, etc. . . . ). As such, it is contemplated that first end 32 of pole 30 may be positioned to any depth below upper surface of the ground or ground level 16, while headstone support 42 is buried entirely underground but may be positioned above line 22, depending on the conditions and applications as described.

The invention is not limited to a galvanized rod and may include any material or means for limiting corrosion of the anchor. Friction between the fins and soil keeps the vertical support shaft in a stationary position. The transfer of load and uplift to the precast concrete vault or headstone support is accomplished by securing the metal cap, with fins in one embodiment, to the shaft. This cap is then encapsulated in grout or concrete creating a bond between the support shaft and the precast concrete vault.

Figure 4:
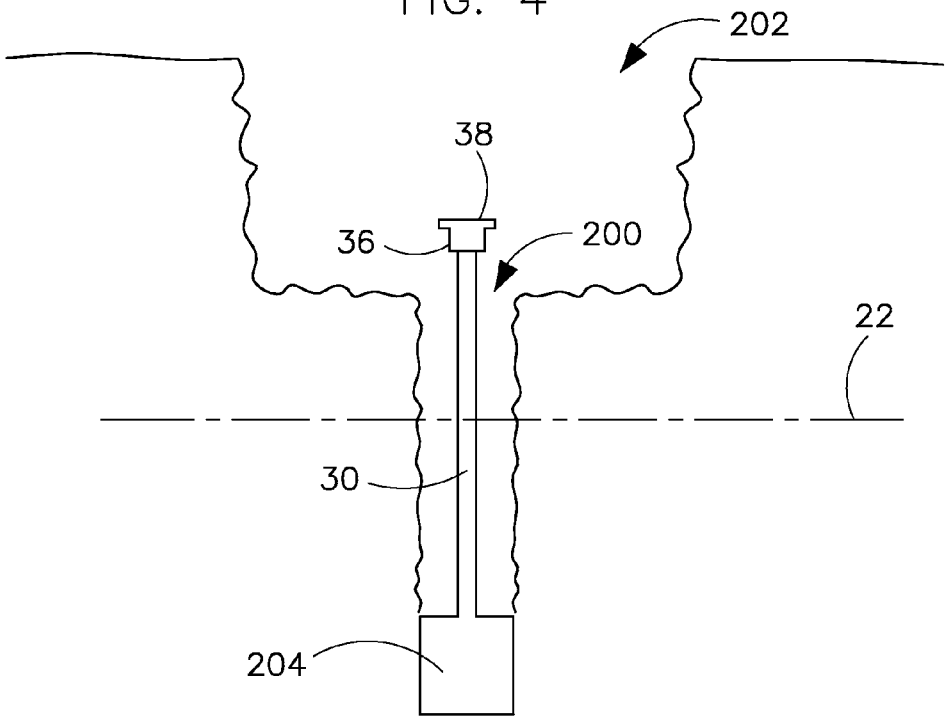
FIG. 4 illustrates an alternate anchor and method of installing the anchor for the headstone support system of FIG. 1.

In an alternate embodiment illustrated in FIG. 4, headstone support system 10 may be fabricated using a pole that is anchored into the ground using a concrete anchor attached to the pole instead of using the helical anchor as described. Referring to FIG. 4, pole 30 is shown positioned in a hole 200. Hole 200 is formed after first excavating the excavation hole 202, corresponding to step 104. Thus, excavation hole 202 is first made, and hole 200 is then made using, for instance, a post-hole digger. Pole 30 is positioned therein having a concrete anchor 204 attached thereto. As with that illustrated in FIG. 1, pole 30 includes anchor cap 36 having flange 38. Thus, in lieu of a drill or auger 52 of FIG. 1, corresponding to step 106 of FIG. 2, pole 30 is anchored below line 22 and in a stable soil that is not prone to motion. Headstone support system 10 of FIG. 4 is completed following steps 108-124 as described above and using corresponding elements of FIG. 1.

It is contemplated that steps 108-124 may be altered according to the invention. For instance, instead of using grout 48 and gravel 50 within headstone support 42, one skilled in the art will recognize that the entire volume of headstone support 42, with headstone 12 positioned therein, can be filled wholly with grout, as an example. In another example, use of Styrofoam 44 may be foregone and headstone support 42 may be positioned directly on gravel base 40.

Figure 5:
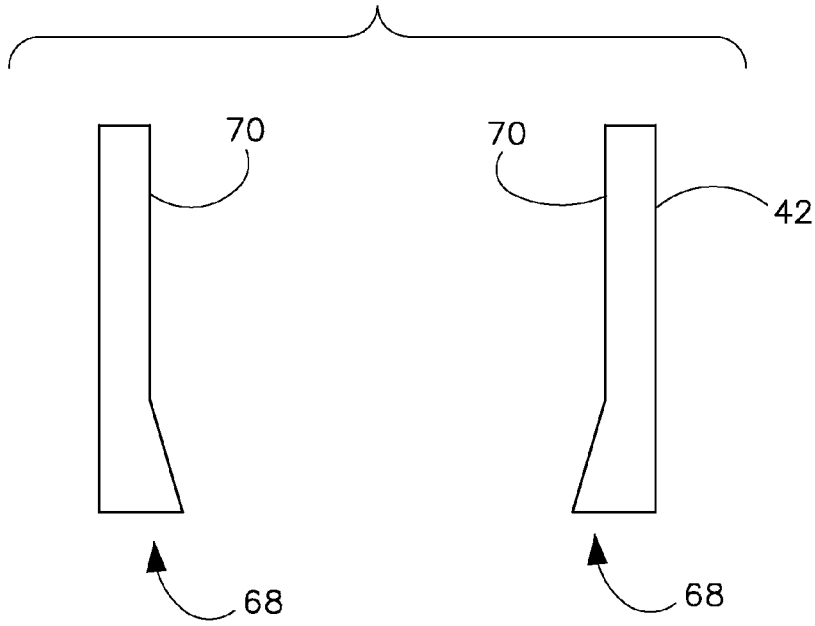
FIG. 5 illustrates a headstone support for the headstone support system of FIG. 1, according to an alternate embodiment of the invention.

According to the invention and referring back to FIG. 1, headstone support 42 includes inner extensions 66 that serve to increase the amount of mechanical coupling of headstone support 42 to auger 52. That is, vertical forces placed on headstone support 42 are prevented from moving headstone support 42 up and down because extensions 66 serve to lock headstone support 42 vertically to prevent vertical motion. However, referring to FIG. 5, an alternate embodiment is illustrated of headstone support 42 having flanges 68 in lieu of extensions 66 illustrated in FIG. 1. One skilled in the art will recognize that any flanges may be applied to surfaces 70 of headstone support 42, and that such flanges may be applied, likewise, to the for and aft walls of headstone support 42 (not shown, in and out of the page) that are used to form the box structure of headstone support 42, so long as opening 46 of headstone support 42 is provided.

As discussed, depth 28 is described as 3-4 feet where the headstone support vault is typically located. The depth of this zone is subject to actual site conditions and may be established based on frost zone, ground conditions, and the like. The length and fin size of the anchor is also subject to actual site conditions and the supporting soil strengths. The grouted area includes, in one embodiment, concrete which bonds the anchor and cap to the precast headstone support vault. The soil within the frost zone is subject to displacement due to soil erosion, rain, irrigation, frost heaving, snow, wind, or impacts. The headstone and vault are supported by the anchor shaft, thereby transmitting the loads and potential for subsidence to the underlying fins and soil below the frost and movement area. In one embodiment, the Styrofoam located below the precast headstone support vault acts as a cushion and compresses or expands depending on any potential movement of the gravel base.

Once the anchor, gravel base, Styrofoam, precast concrete vault, and grout are installed and allowed to cure, the vault may be backfilled with gravel or other filler material to provide additional anchor, weight, or ballast, and the headstone installed. The length and fin sizes of the anchor are subject to the actual soil conditions at the site. In one embodiment, the anchor is augered into the soil (using the helical flanges) to a predetermined depth based on onsite soil conditions. According to another embodiment, a hole may be dug and the auger having the flanges is positioned therein and backfilled with concrete or sand slurry or dirt. In such an embodiment it may not be necessary to include helical flanges—rather non-helical discs or a concrete block may instead be provided which serve the purpose of establishing a stable base. The shaft may be field cut to allow the placement of the anchor cap. A pilot hole is drilled into the shaft to accept a bolt thereby securing the cap to the shaft.

The dimensions and keyway for the precast concrete headstone support vault are selected such that grout locks the vault to the anchor preventing movement to the vault and corresponding headstone. Optional drain holes (not shown) could be incorporate into the precast concrete vault, above the grout line, to allow moisture to drain from within the vault to the surrounding soil area reducing hydrostatic head around the headstone.

This invention will minimize headstone movement by adding support to the headstone. Installation is quick, reducing construction and installation time thereby minimizing restoring of the grave site and cemetery operations. Loads from construction equipment over the existing graves are reduced due to the relatively small equipment utilized in the installation process.

Thus, top-heavy headstones or tombstones made of dense materials such as marble may be supported where wet soil conditions and/or freeze/thaw cycles occur. The embodiments disclosed act like a small spread footing to support the headstones. Should severe soil conditions occur, a helical anchor support system may be incorporated into the design.

According to one embodiment, a headstone support system includes a pole having a first auger attached to the pole proximate a first end thereof, the first auger configured to drill through soil upon rotation of the pole, and a headstone support attached to a second end of the pole.

According to another embodiment, a method of fabricating a headstone support system includes attaching an auger to a first end of a pole such that, when the pole is rotated and pressed into the ground, the auger is driven below a surface of the ground, wherein when the auger is below the surface of the ground, a second end of the pole is also below the surface of the ground but at a lesser depth than the auger, and fabricating a headstone support attachable to the second end of the pole such that, when the headstone support is attached to the second end of the pole, the headstone support is below the surface of the ground.

According to yet another embodiment, a method of installing a headstone support system includes drilling a pole having an auger on a first end thereof into the ground, and attaching a headstone support to a second end of the pole that is opposite the first end of the pole.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A headstone support system for a gravesite comprising:

a pole having an auger configured to drill through soil upon rotation of the pole; and a headstone support coupled to the pole via an anchor cap that is positioned below a ground level and attached to the pole, the headstone support comprising an upper surface and a lower surface;

wherein:

the upper and lower surfaces of the headstone support are both positioned below the ground level; and the headstone support includes an opening passing through the lower surface such that a material positioned within the headstone support is in direct contact with a base that is beneath the headstone support.

2. The headstone support system of claim 1 wherein a length of the pole is such that the auger is greater than six feet below the ground level.

3. The headstone support system of claim 1 wherein the first auger is positioned on a first end of the pole such that the first auger is positioned below a line in the soil that is prone to motion, and a second end of the pole is positioned above the line in the soil that is prone to motion but below the ground level, and wherein the line in the soil that is prone to motion is at a depth below the ground level in which cyclical freezing and thawing typically does not occur during seasonal freeze/thaw cycles.

4. The headstone support system of claim 1 wherein the material positioned within the headstone support comprises one of a grout and a concrete substance, wherein the material couples the headstone support to the pole via the anchor cap, and wherein the anchor cap is positioned within the one of the grout and the concrete substance.

5. The headstone support system of claim 4 wherein the headstone is positioned within the headstone support above the one of the grout and the concrete substance that is positioned within the headstone support.

6. A method of fabricating a headstone support system for a gravesite comprising:

attaching an auger to a first end of a shaft such that, when the shaft is rotated and pressed into the ground, the auger is driven below a surface of the ground, wherein after the auger is driven below the surface of the ground, a second end of the shaft is also below the surface of the ground;

fabricating a headstone support attachable to the second end of the shaft such that, when the headstone support is attached to the second end of the shaft, the headstone support is entirely below the surface of the ground;

forming an opening in a bottom of the headstone support such that a material positioned within the headstone support is in direct contact with a base that is beneath the headstone support; and providing a base such that when the base is positioned within a hole in the ground, the second end of the shaft passes through the base and is above the base.

7. The method of claim 6 comprising fabricating the shaft having a length such that the auger is driven below a line in the ground that is prone to motion but the second end of the shaft is above the line in the ground that is prone to motion.

8. The method of claim 6 comprising fabricating an anchor cap that is attachable to the second end of the shaft and such that the second end of the shaft is attachable to the headstone support via the anchor cap and via one of a grout and a concrete substance that is positioned within the headstone support, wherein the anchor cap is positioned within the one of the grout and the concrete.

9. A method of installing a headstone support system for a gravesite comprising:

drilling a pole having an auger on a first end thereof into the ground and approximately along a centerline of the gravesite;

attaching a headstone support to a second end of the pole that is opposite the first end of the pole;

attaching an anchor cap to the second end of the pole;

positioning a fill material within the headstone support such that the anchor cap is positioned within the fill material; and positioning the fill material in direct contact with a base material upon which the headstone support is positioned.

10. The method of claim 9 comprising drilling the auger to a depth that is below a level in the ground that is prone to motion, wherein the level in the ground that is prone to motion is a level at which cyclical freezing and thawing does not occur during seasonal freeze/thaw cycles.

11. The method of claim 9 comprising positioning the fill material within the headstone support such that the headstone support is attached to the second end of the pole via the anchor cap and via the fill material.

12. The method of claim 11 wherein the fill material is one of a grout and a concrete mixture.

13. The headstone support system of claim 1 wherein the pole is positioned in the soil axially offset from a coffin positioned in the gravesite.

14. The headstone support system of claim 1 wherein the pole is positioned to pass through the base.

15. The headstone support system of claim 1 wherein the headstone support is positioned such that its weight bears upon the base.

16. The headstone support system of claim 1 wherein the pole is positioned approximately along a centerline of a coffin that is within the gravesite.

17. The headstone support system of claim 1 comprising an extension extending inwardly from an inner surface of the headstone support to increase an amount of coupling between the headstone support and the auger and lock the headstone support to prevent the headstone support from moving up and down.

18. The method of claim 6 wherein the base material is gravel and the material is one of a grout and a concrete mixture.

19. A method of installing a headstone support system for a gravesite comprising:

drilling a pole having an auger on a first end thereof into the ground and approximately along a centerline of the gravesite;

attaching a headstone support to a second end of the pole that is opposite the first end of the pole;

attaching an anchor cap to the second end of the pole; and positioning a fill material within the headstone support such that the anchor cap is positioned within the fill material;

wherein the fill material is one of a grout and a concrete mixture, and wherein positioning the fill material comprises positioning the fill material at least partially atop an extension that extends from an inner wall of the headstone support to increase an amount of coupling between the headstone support and the auger and lock the headstone support to prevent the headstone support from moving up and down.

* * * * *

UNITED STATES PATENT AND TRADEMARK OFFICE

CERTIFICATE OF CORRECTION

PATENT NO. : 8,555,561 B2
APPLICATION NO. : 13/295164
DATED : October 15, 2013
INVENTOR(S) : Robert D. Dickinson et al.

It is certified that error appears in the above-identified patent and that said Letters Patent is hereby corrected as shown below:

In the Claims

At column 8, line 60, claim number 3, line number 2, in the phrase "first auger", the word "first" should be deleted from the claim.

At column 8, line 61, claim number 3, line number 3, in the phrase "first auger", the word "first" should be deleted from the claim.

Signed and Sealed this
Twenty-sixth Day of November, 2013

Margaret A. Focarino

Margaret A. Focarino
*Commissioner for Patents of the United States Patent and Trademark Office*